US011118295B2

(12) United States Patent
Bhandare et al.

(10) Patent No.: US 11,118,295 B2
(45) Date of Patent: Sep. 14, 2021

(54) LAUNDRY TREATING APPLIANCE HAVING A USER INTERFACE WITHIN A DOOR ASSEMBLY

(71) Applicant: WHIRLPOOL CORPORATION, Benton Harbor, MI (US)

(72) Inventors: Snehal S. Bhandare, Maharashtra (IN); Yogesh Dhanabalan Chandrasekaran, Pune (IN); Jose Aldo Ramirez, Monterrey (MX); Scott T. Thalls, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 211 days.

(21) Appl. No.: 16/137,093

(22) Filed: Sep. 20, 2018

(65) Prior Publication Data

US 2019/0145041 A1 May 16, 2019

Related U.S. Application Data

(60) Provisional application No. 62/587,078, filed on Nov. 16, 2017.

(51) Int. Cl.

| | |
|---|---|
| ***D06F 39/14*** | (2006.01) |
| ***D06F 34/28*** | (2020.01) |
| ***D06F 33/00*** | (2020.01) |

(52) U.S. Cl.

CPC ..... *D06F 34/28* (2020.02); *D06F 33/00* (2013.01); *D06F 39/14* (2013.01); *D06F 2212/02* (2013.01); *D06F 2216/00* (2013.01)

(58) Field of Classification Search

CPC ..... D06F 34/28; D06F 37/10; D06F 37/28; D06F 39/14; D06F 2212/00; D06F 2212/02; D06F 2216/00

See application file for complete search history.

(56) References Cited

U.S. PATENT DOCUMENTS

| | | | |
|---|---|---|---|
| 7,320,186 | B2 | 1/2008 | Schone |
| 7,559,156 | B2 | 7/2009 | Renzo |
| 7,730,749 | B2 | 6/2010 | Yun |
| 7,765,839 | B2 | 8/2010 | Chung |
| 7,777,502 | B2 | 8/2010 | Grosser |

(Continued)

FOREIGN PATENT DOCUMENTS

| | | | |
|---|---|---|---|
| BR | 202013015525 | U2 | 8/2015 |
| CN | 2701894 | Y | 5/2005 |

(Continued)

OTHER PUBLICATIONS

European Search Report for Counterpart EP18205788.5, dated Mar. 29, 2019.

*Primary Examiner* — Marc Lorenzi

(74) *Attorney, Agent, or Firm* — McGarry Bair PC

(57) ABSTRACT

A laundry treating appliance includes a cabinet defining an interior, a drum located within the interior and defining a treating chamber, and a door assembly coupled to the cabinet to selectively open and close the treating chamber and at least partially defining the treating chamber when the door assembly is in a closed condition. The door assembly includes an intermediate door defining an opening, a user interface, a door window, a door cover adjacent the front surface of the intermediate door, a rear door, and a trim element.

18 Claims, 19 Drawing Sheets

(56) References Cited

U.S. PATENT DOCUMENTS

| | | | | |
|---|---|---|---|---|
| 7,843,200 | B2 | 11/2010 | Klopfer | |
| 7,931,114 | B2 | 4/2011 | LeClear | |
| 7,934,404 | B2 | 5/2011 | Ha | |
| 8,253,582 | B2 | 8/2012 | Cho | |
| 8,368,805 | B2 | 2/2013 | Kim | |
| 8,567,976 | B2 | 10/2013 | Hamlin | |
| 8,616,030 | B2 | 12/2013 | Hoppe | |
| 9,093,884 | B2 | 7/2015 | Major | |
| 9,212,449 | B2 | 12/2015 | Fang | |
| 9,428,855 | B2 | 8/2016 | Park | |
| 9,615,468 | B2 | 4/2017 | Moncrieff | |
| 2007/0125132 | A1* | 6/2007 | Hwang | D06F 39/14 68/3 R |
| 2013/0091904 | A1 | 4/2013 | Kim | |
| 2013/0277353 | A1 | 10/2013 | Joseph | |
| 2015/0008807 | A1* | 1/2015 | Kim | D06F 37/28 312/228 |
| 2015/0245734 | A1 | 9/2015 | Vogelsang | |
| 2016/0186985 | A1 | 6/2016 | Kim | |
| 2017/0121889 | A1* | 5/2017 | Kwon | D06F 34/28 |
| 2017/0121890 | A1 | 5/2017 | Kwon | |
| 2017/0121891 | A1 | 5/2017 | Cheon et al. | |
| 2019/0112746 | A1* | 4/2019 | Chi | D06F 37/28 |

FOREIGN PATENT DOCUMENTS

| | | | |
|---|---|---|---|
| CN | 103132292 | A | 6/2013 |
| CN | 103526515 | A | 1/2014 |
| CN | 203530713 | U | 4/2014 |
| CN | 204551072 | U | 8/2015 |
| CN | 105908453 | A | 8/2016 |
| DE | 19515040 | A1 | 10/1996 |
| DE | 102007061522 | A1 | 6/2009 |
| DE | 202014005929 | U1 | 9/2014 |
| EP | 0293984 | A1 | 12/1988 |
| EP | 0870861 | A1 | 10/1998 |
| EP | 1907616 | A1 | 4/2008 |
| EP | 2031121 | A1 | 3/2009 |
| EP | 1654411 | B1 | 4/2010 |
| EP | 2098627 | B1 | 9/2010 |
| EP | 2543306 | A1 | 1/2013 |
| EP | 2604750 | A1 | 6/2013 |
| EP | 2481845 | B1 | 6/2014 |
| EP | 2843107 | A1 | 3/2015 |
| EP | 2873764 | A1 | 5/2015 |
| EP | 2861792 | B1 | 8/2016 |
| EP | 2837726 | B1 | 10/2016 |
| EP | 3164537 | B1 | 1/2018 |
| KR | 100379468 | B1 | 4/2003 |
| KR | 100452372 | B1 | 10/2004 |
| KR | 20150006264 | A | 1/2015 |
| WO | 2007000645 | A1 | 1/2007 |
| WO | 2012054132 | A1 | 4/2012 |
| WO | 2012153261 | A1 | 11/2012 |
| WO | 2014118295 | A1 | 8/2014 |
| WO | 2016034224 | A1 | 3/2016 |
| WO | 2016072596 | A1 | 5/2016 |
| WO | 2016078191 | A1 | 5/2016 |
| WO | 2016135285 | A1 | 9/2016 |
| WO | 2017020961 | A1 | 2/2017 |
| WO | 2017167080 | A1 | 10/2017 |

* cited by examiner

LAUNDRY TREATING APPLIANCE HAVING A USER INTERFACE WITHIN A DOOR ASSEMBLY

CROSS-REFERENCE TO RELATED APPLICATIONS

This application claims the benefit of U.S. Provisional Patent Application No. 62/587,078, filed on Nov. 16, 2017, which is incorporated herein by reference in its entirety.

BACKGROUND

Laundry treating appliances, such as clothes washers, clothes dryers, refreshers, and non-aqueous systems, can have a configuration based on a rotating laundry basket that defines a treating chamber in which laundry items are placed for treating. The laundry treating appliance can include a cabinet including a panel with an access opening through which clothes are loaded and unloaded into the treating chamber. A door assembly can be movably mounted to the cabinet to selectively open and close the access opening to the treating chamber. The door assembly can include multiple door pieces to support various parts of the door assembly, such as a transparent or partially transparent viewing window, a hinge assembly, and a user interface for the laundry treating appliance.

BRIEF SUMMARY

In one aspect, illustrative embodiments in accordance with the present disclosure relate to a laundry treating appliance comprising a cabinet defining an interior, a drum located within the interior and defining a treating chamber, and a door assembly coupled to the cabinet to selectively open and close the treating chamber and at least partially defining the treating chamber when the door assembly is in a closed condition. The door assembly comprises an intermediate door having front and rear surfaces, defining an opening, and having a plurality of receiving openings forming a first part of a heat stake connection, a user interface mounted to the intermediate door, a door window mounted to the intermediate frame and overlying the opening, a door cover adjacent the front surface of the intermediate door and overlying the user interface, a rear door adjacent the rear surface of the intermediate door, and a trim element provided about at least a periphery of the intermediate door and having a plurality of posts, the posts configured to be received within the receiving openings and forming a second part of the heat stake connection, the posts and receiving openings collectively forming the heat stake connection to create a plurality of caps to secure the trim element to the intermediate door.

In another aspect, illustrative embodiments in accordance with the present disclosure relate to a laundry treating appliance comprising a cabinet defining an interior, a drum located within the interior and defining a treating chamber, and a door assembly coupled to the cabinet to selectively open and close the treating chamber and at least partially defining the treating chamber when the door assembly is in a closed condition. The door assembly comprises an intermediate door having front and rear surfaces and defining an opening, a user interface mounted to the intermediate door, a door window mounted to the intermediate frame and overlying the opening, a door cover adjacent the front surface of the intermediate door and overlying the user interface, a rear door adjacent the rear surface of the intermediate door, a trim element provided about at least a periphery of the intermediate door, and a heat stake connection comprising a plurality of posts on one of the intermediate door or the trim element and a plurality of receiving on the other of the intermediate door or the trim element, the posts configured to be received within the receiving openings and thermally deformed to create a plurality of caps to secure the trim element to the intermediate door.

DETAILED DESCRIPTION

Figure 1:
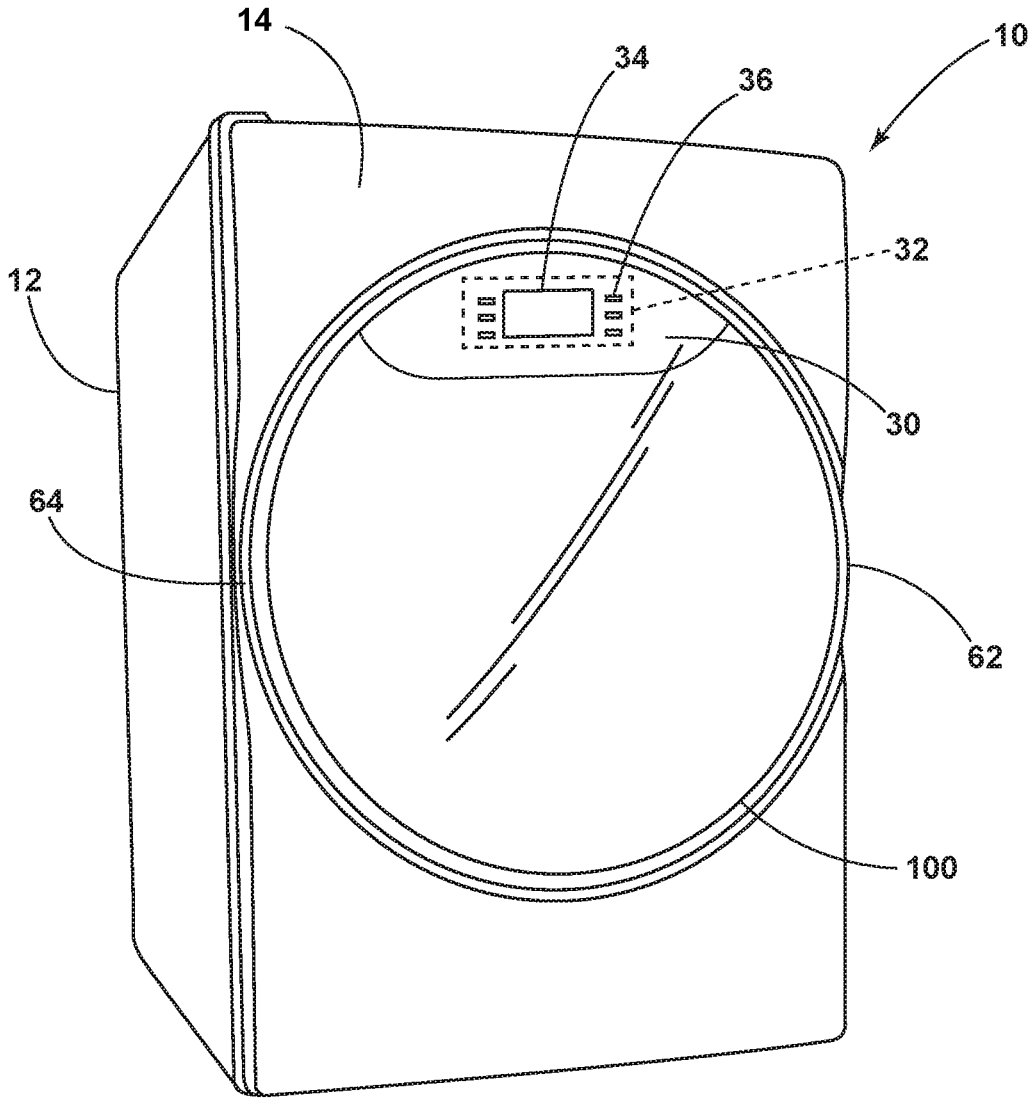
FIG. 1 illustrates a perspective view of a laundry treating appliance according to an embodiment of the present disclosure.

Aspects of the disclosure relate to a door assembly for a laundry treating appliance. Door assemblies for laundry treating appliances can include a variety of features and components, including, but not limited to, a transparent viewing window area, structures for preventing the passage of liquid from the interior of the laundry treating appliance to the exterior of the laundry treating appliance, and even a user interface and display area. A viewing window for the user interface and display area can be accompanied by screen decoration to cover the associated electronics and provide a clean aesthetic to the user. Additionally, the structure of the door cover can be altered in the area of the user interface to provide a flat, angled surface for the user interface that allows for high acuity of a touch screen. Speaker openings can also be provided in the door assembly for improved transmission of auditory cues to a user.

When the user interface is located on or within the door assembly of a laundry treating appliance, the door assembly can include additional features and structures to ensure that the user interface can operate properly within the door assembly and that electronic components are protected from liquid within the laundry treating appliance. By way of non-limiting example, the door assembly can include structures to keep liquid from contacting electronic components of the user interface, such as gaskets and water diverting channels, and structures to ensure that sensitivity of the user interface and its associated electronics and functions are optimized for ease of function and operability.

Such a door assembly can comprise multiple components that together form the door assembly. The use of multiple components to form the door assembly can require additional consideration to ensure that the door assembly is assembled in an efficient manner that allows for a durable door assembly and sturdy connections between the multiple components of the door assembly. The use of specialized fasteners, hooks, and heat staking can improve assembling of the components of the door assembly. Snaps for a viewing window can serve not only to secure the window piece, but to center it within the door assembly.

The door assembly of the present disclosure has applicability in a variety of laundry treating appliances, including, but not limited to, both laundry washing appliances and laundry drying appliances. While certain aspects of the door assembly can be the same regardless of whether the door assembly is used in the context of a laundry washing appliance or a laundry drying appliance, it will also be understood that other aspects of the door assembly can be different depending on whether the door assembly is used in the context of a laundry washing appliance or a laundry drying appliance. By way of non-limiting example, the features of the viewing window or the structures for water protection or transmission of sound can differ depending on the context in which the door assembly is intended to be used.

In more detail, and referring to FIG. 1, a laundry treating appliance 10 according to an aspect of the disclosure can be any laundry treating appliance 10 that performs a cycle of operation to clean or otherwise treat laundry items placed therein. The laundry treating appliance 10 is illustrated herein as a horizontal axis, front-load laundry treating appliance 10, such as, but not limited to, a washing machine or a laundry dryer. However, it will be understood that the embodiments of the present disclosure can have applicability in other horizontal axis laundry treating appliances, non-limiting examples of which include a combination washing machine or dryer, a refreshing/revitalizing machine, an extractor, or a non-aqueous washing apparatus, or also a horizontal axis laundry treating appliance that is top-loading. Depending on the configuration, it is possible for the embodiments to have applicability in vertical axis laundry treating appliances and other appliances having a door, whether it be hinged, slidable, or otherwise attached to a cabinet, with access to a treating chamber. The laundry treating appliance shares many feature of a conventional automated clothes washer and/or dryer, which will not be described in detail herein except as necessary for a complete understanding of the exemplary embodiments in accordance with the present disclosure.

The laundry treating appliance 10 can include a structural support assembly comprising a cabinet 12 defining a housing within which a laundry holding assembly resides. The cabinet 12 can be a housing having a chassis and/or a frame, defining an interior, enclosing components typically found in a conventional washing machine or drying machine. Conventional washing machine or drying machine components are not described in detail, but are described briefly as needed to provide an illustrative environment to support a complete understanding of aspects of the present disclosure.

Figure 2:
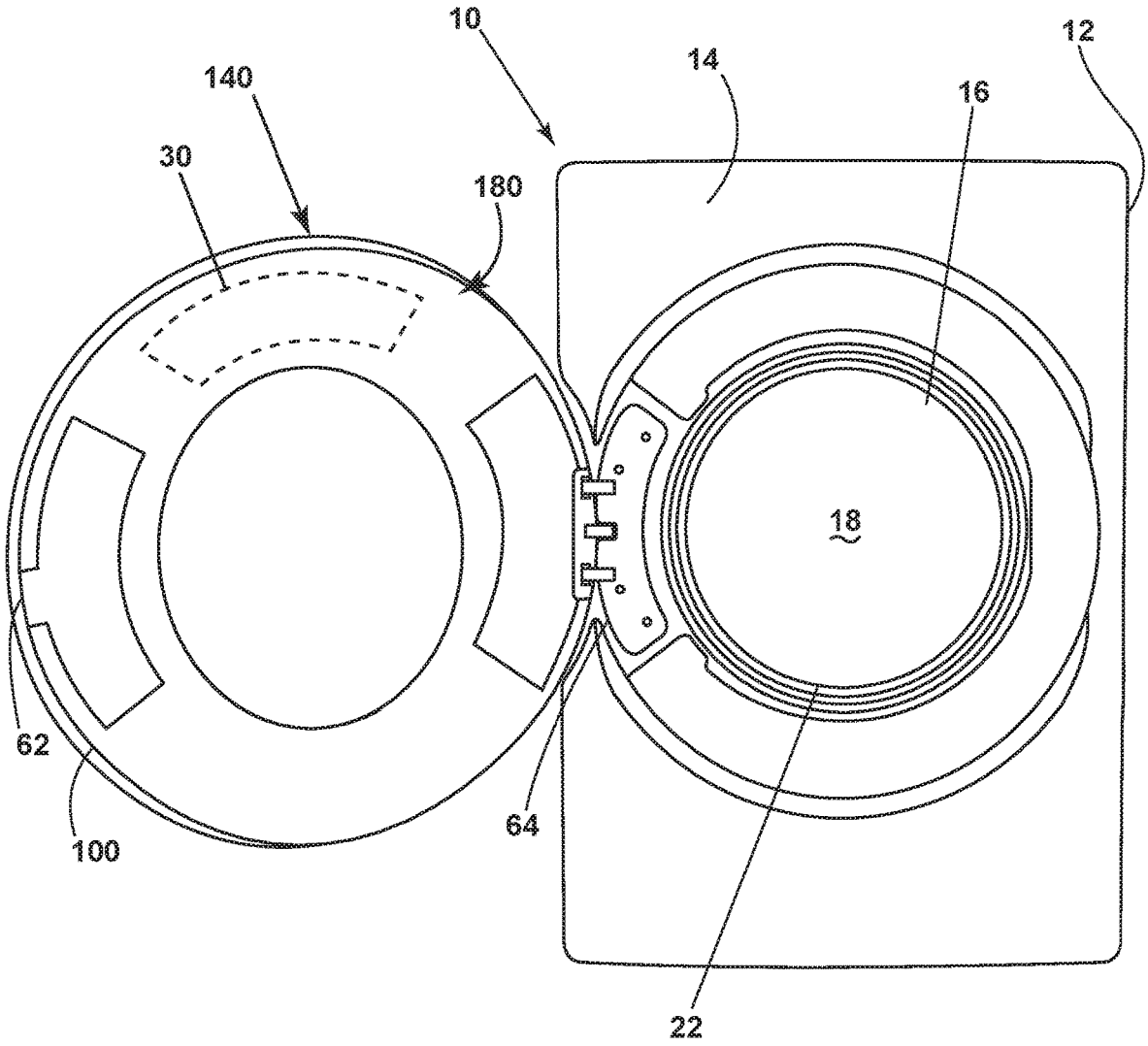
FIG. 2 illustrates a front view of a portion of the laundry treating appliance of FIG. 1 with a door assembly in an open condition according to the present disclosure.

Referring now to FIG. 2, the laundry holding assembly may include a rotatable drum 16 supported within the cabinet 12 by a suitable suspension assembly and defining at least a portion of a laundry treating chamber 18 for receiving the laundry and which rotates about a rotational axis, which for convenience, but not limitation, happens to be illustrated as a generally horizontal axis. The drum 16 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. An access opening 22 in a front panel 14 of the cabinet 12 provides access to the laundry treating chamber 18.

The laundry holding assembly may further include a door assembly 100 which can be movably mounted to the cabinet 12 to selectively close the access opening 22 to the treating chamber 18. The door assembly 100 can have a handle 62 for pivotally opening the door about a hinge assembly 64. The door assembly 100 can further include an integrated user interface 30 comprising a plurality of buttons 36, which can be touch sensitive buttons 36, a display module 34, which can be a touch sensitive liquid crystal display module 34, and a user interface controller 32. While the user interface 30 is illustrated as a touch control panel, the user interface can be any form of human machine interface, such as, but not limited to, a mechanical touch surface, a capacitive touch surface, a set of mechanical buttons or mechanical knobs for controlling the operation of the laundry treating appliance, or a combination of any of these. The door assembly 100 comprises an outer door assembly 140, the display module 34, and an inner door assembly 160 (FIG. 13) or 180 (FIG. 18) that, when coupled together, form the door assembly 100. FIG. 1 shows the door assembly 100 in a closed condition and FIG. 2 shows the door assembly 100 in an open condition.

Figure 3:
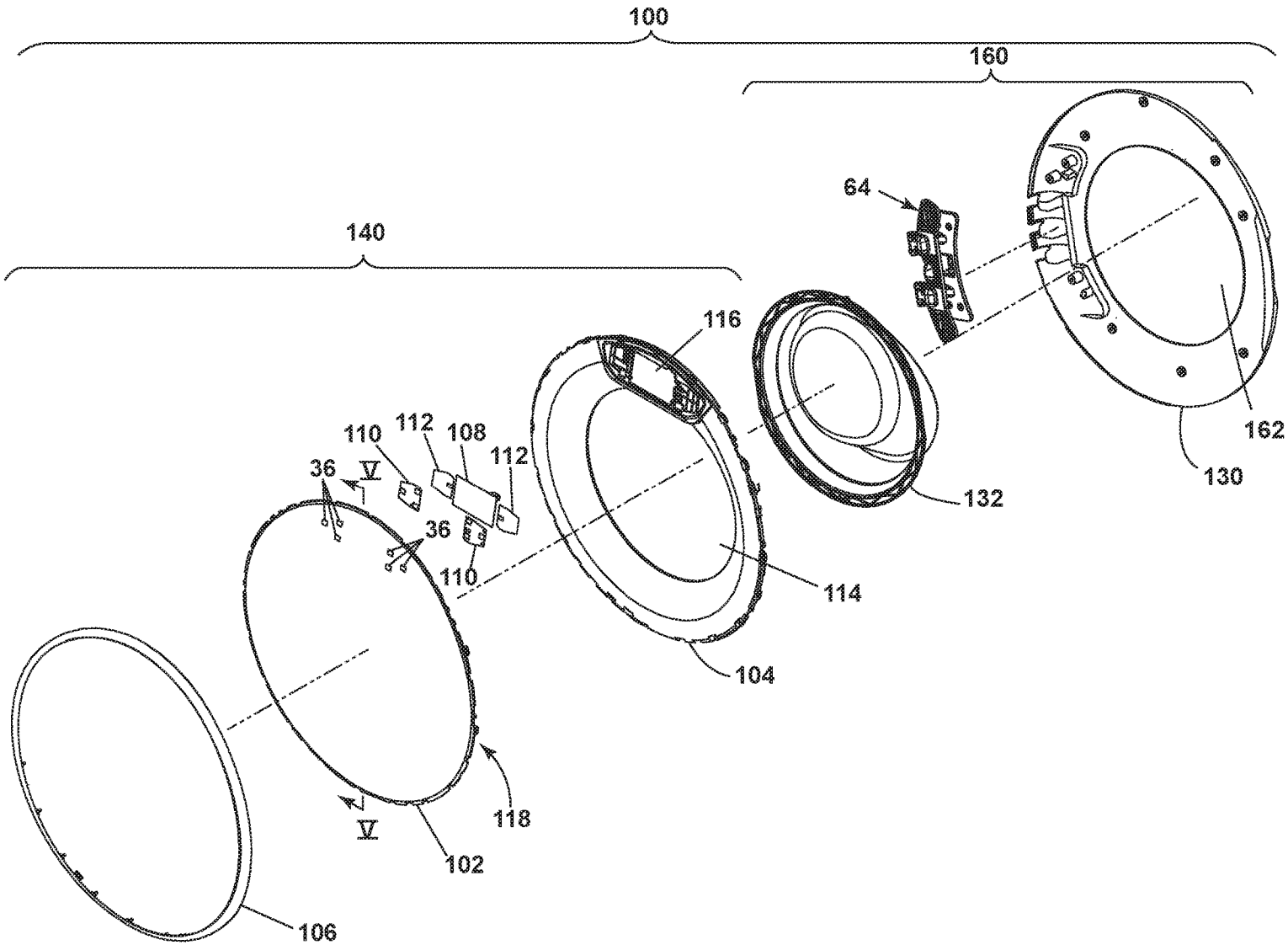
FIG. 3 illustrates an exploded view of the door assembly of FIG. 1 including an inner door assembly and an outer door assembly according to an embodiment of the present disclosure.

Turning now to the components of the door assembly 100, FIG. 3 illustrates an exploded view of an exemplary embodiment of the door assembly 100 including the outer door assembly 140 and the inner door assembly 160, and that includes a portion of the user interface 30. A door cover 102 provides the front surface for the door assembly 100. In an exemplary embodiment, the door cover 102 is formed of a plastic material. However, it will be understood that glass, composite, or other suitable material can be used to form the door cover 102. The door cover 102 can be partially transparent to allow a user to view the treating chamber 18, or can be entirely transparent across the entirety of the door cover 102. The door cover 102 can also include the plurality of buttons 36.

An intermediate door 104 is also provided, and can be positioned to the rear of the door cover 102. The intermediate door 104 can be formed of plastic, metal, or any suitable composition. The intermediate door 104 includes a central opening 114 and a display opening 116. The central opening 114 can be configured to line up with a transparent portion of the door cover 102 to allow a user to view the treating chamber 18 through the door assembly 100, even when the door assembly 100 is in the closed condition. The display opening 116 can also be configured to line up with a second transparent portion of the door cover 102, to allow a user to view the user interface 30. The door cover 102 can have separate transparent portions corresponding to the central opening 114 and the display opening 116 of the intermediate door 104, or the entire door cover 102 can be transparent. It will also be understood that the transparent portion or portions of the door cover 102 are not limited to being the size and shape of the central opening 114 or the display opening 116, but could also be larger or smaller than the central opening 114 or the display opening 116.

A trim element, illustrated herein as a peripheral trim ring 106, is provided and can be configured to be coupled with and to surround the peripheral edges of at least the door cover 102 and the intermediate door 104. The peripheral trim ring 106 can be formed of plastic, metal, or any suitable composition. A touch film 108 is provided. In an exemplary embodiment, the touch film 108 is adhesively bonded to a rear surface 118 of the door cover 102, though it will be understood that the touch film 108 can be attached to the door cover 102 in any other suitable manner, non-limiting examples of which include mechanical attachment or being held against the door cover 102 by pressure from another component of the door assembly 100. In an exemplary embodiment, the touch film 108 is adhered to the rear surface 118 of the door cover 102 such that the touch film 108 is aligned with the display opening 116 of the intermediate door 104 when the door assembly 100 is fully assembled.

At least one circuit board 112 can also be included. In an exemplary embodiment, the circuit board 112 can be a flexible printed circuit board (PCB), though it will also be understood that the PCB is not required to be flexible, but could be a standard PCB. While the door assembly 100 is illustrated as having two circuit boards 112, one on either side of the touch film 108, it will be understood that any suitable number of circuit boards 112, including a single circuit board 112, can be provided, and that the at least one circuit board 112 can be provided at any position on the door cover 102, either adjacent to or not adjacent to the touch film 108. The circuit boards 112 can be adhered to the rear surface 118 of the door cover 102 by the use of an adhesive layer 110. The adhesive layer 110 can have a shape that corresponds to that of the at least one circuit board 112, or can only be present between the rear surface 118 and the at least one circuit board 112 over a portion of the surface of the at least one circuit board 112. In an exemplary embodiment, the at least one circuit board 112 is adhered to the rear surface 118 of the door cover 102 such that the at least one circuit board 112 is aligned with the buttons 36 of the door cover 102 when the door assembly 100 is fully assembled.

The peripheral trim ring 106, the door cover 102, the touch film 108, the at least one circuit board 112, the adhesive layer 110, and the intermediate door 104 can be collectively thought of as comprising an outer door assembly 140. In an exemplary embodiment, the peripheral trim ring 106, the door cover 102, and the intermediate door 104 that form a portion of the outer door assembly 140 are all formed of plastic.

Figure 4:
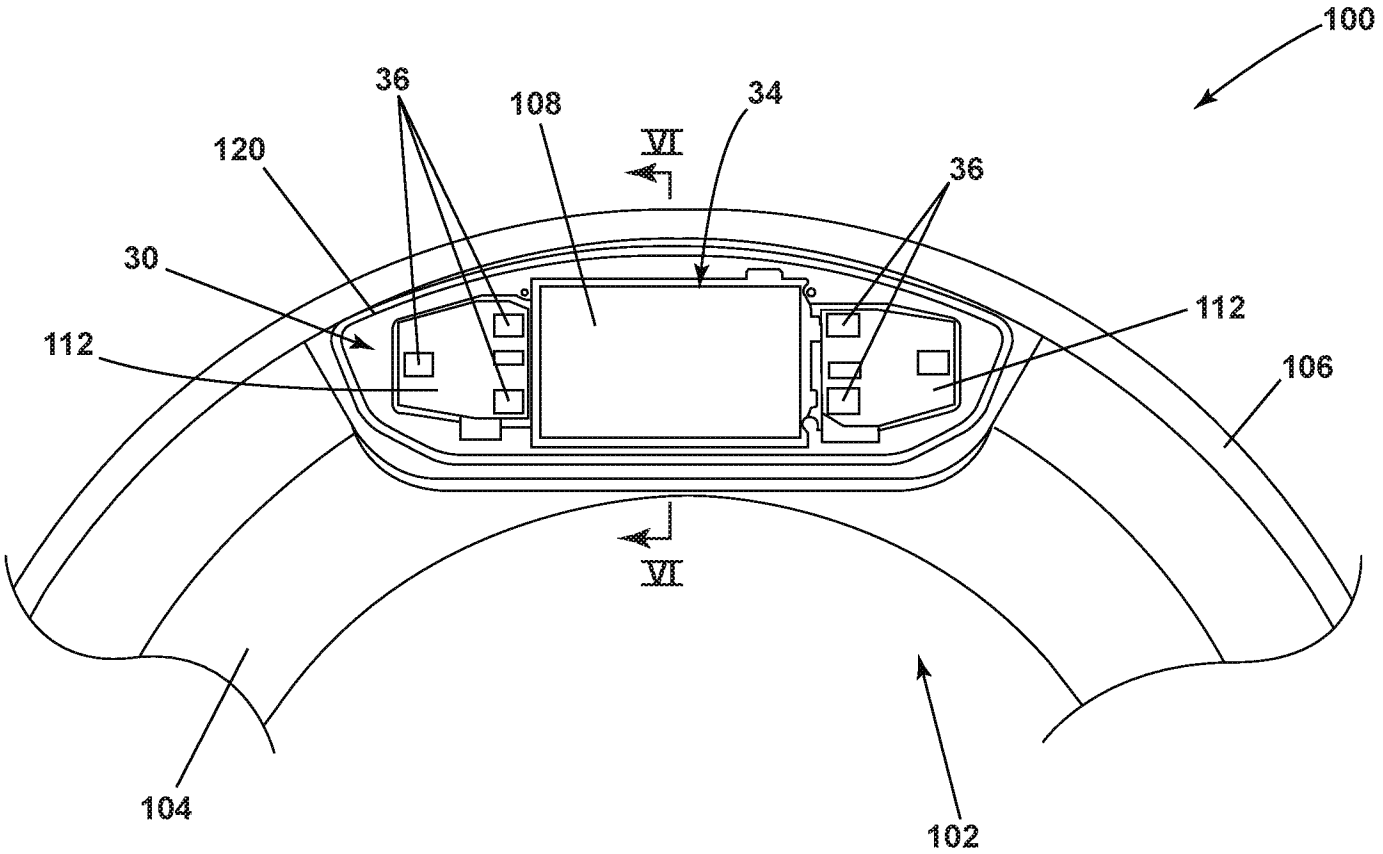
FIG. 4 illustrates a front view of a portion of the outer door assembly of FIG. 3 according to the present disclosure.

Referring now to FIG. 4, a front view of a portion of the door assembly 100 containing the user interface 30 is illustrated. The view of FIG. 4 shows the at least one circuit board 112 being aligned with the buttons 36 to provide the appropriate electrical circuitry for the functioning of the buttons 36. Although the display module 34, which can be provided as a touch screen user interface display module 34 as enabled by the touch film 108, can provide primary input functions for the user interface 30, a user may desire that there be additional buttons 36. By way of non-limiting example, the buttons 36 provided in addition to the touch screen user interface display module 34 can be hard-coded buttons that a user may desire to be always available regardless of the status of the display module 34, such as a power button. When the laundry treating appliance 10 is powered off, or when the touch screen user interface display module 34 is in an inactive condition and is not actively displaying information, the presence of the hard-coded buttons 36 ensures that specific desired functions and controls are always available to the user and readily identifiable.

Figure 5:
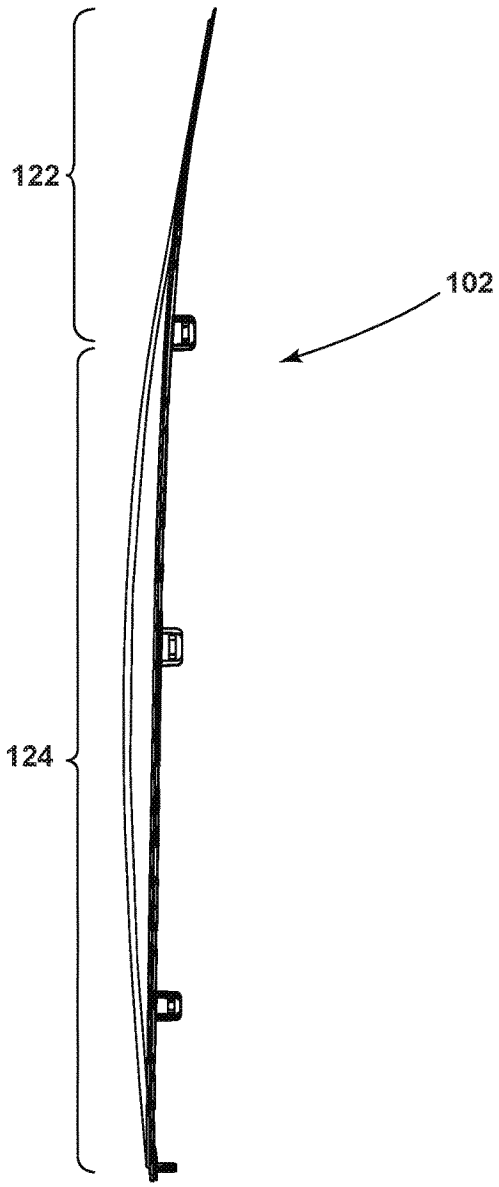
FIG. 5 illustrates a cross-sectional view of a door cover for use with the outer door assembly of FIG. 3 taken along line V-V of FIG. 3.

Turning now to FIG. 5, the door cover 102 can have structural features to improve the operability of the user interface 30 within the door assembly 100, as shown in the cross-sectional view of the door cover 102. The door cover 102 includes an upper portion 122 and a lower portion 124. In an exemplary embodiment, the upper portion 122 corresponds to the position of the user interface 30, and the upper portion is relatively flat. The lower portion 124 can be located outside the position of the user interface 30, and can have a convex surface in cross-section. By aligning the flat upper portion 122 of the door cover 102 with the user interface 30, improved acuity and function of the user interface 30 can be attained.

Figure 6:
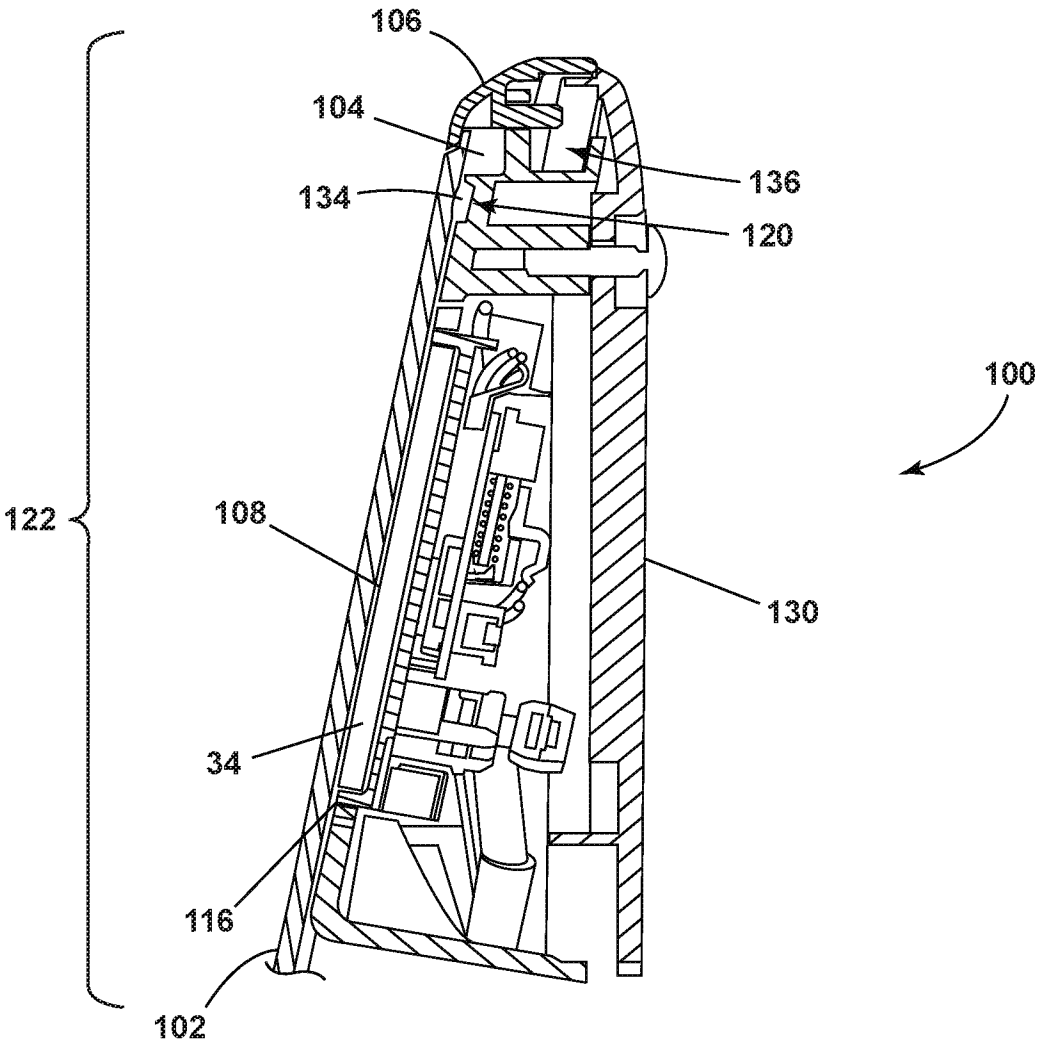
FIG. 6 illustrates an enlarged cross-sectional view of the door assembly of FIG. 1 taken along line VI-VI of FIG. 4.

FIG. 6 illustrates a cross-sectional view of the flat upper portion 122 of the door cover 102 within the door assembly 100. Behind the flat upper portion 122 of the door cover 102, the touch film 108 is positioned. Behind the touch film 108, the display module 34 is positioned within the display opening 116 of the intermediate door 104, immediately behind the touch film 108. By having the touch film 108 and the display module 34 adjacent the flat upper portion 122 of the door cover 102, any air gap that would exist between the door cover 102 and the display module 34 if the door cover 102 were curved is eliminated, such that improved touch performance is achieved by the touch film 108 and the display module 34. The upper portion 122 of the door cover 102 being flat also makes it easier for the touch film 108 and the at least one circuit board 112 to be adhered to the rear surface 118 of the door cover 102, with less chance of wrinkling or air bubbles as compared to adhesion to a curved surface. Additionally, the presence of the flat upper portion 122 of the door cover 102 results in the user interface 30 being presented to the user in a tilted manner, which improves visibility and ergonomic performance for the user, as the flat upper portion 122 is likely to be below the height of an average user. In this way, the flat upper portion 122 presents the user interface 30 to a user such that the display module 34 is visually tilted towards the user for ease of use. In one aspect of the disclosure, by way of non-limiting example, the flat upper portion 122 of the door cover 102 where the user interface 30 is located can be provided at an angle of 10.4° relative to vertical, though it will be understood that any suitable angle can be used, including an angle larger than 10.4° relative to vertical.

To further improve usability of the user interface 30, it is also contemplated that the upper portion 122 and the lower portion 124 can have differing thicknesses, such that the upper portion 122 of the door cover 102 is thinner than the lower portion 124. By having the upper portion 122 adjacent the touch film 108 and the display module 34 have a decreased thickness relative to the lower portion 124, the sensitivity, or the touch resolution, of the touch film 108 to a touch by a user can be improved. In an exemplary embodiment, the lower portion 124 of the door cover can have a thickness of 3.5 millimeters, while the upper portion 122 has a thickness of 2.5 millimeters. It will also be understood that while the upper portion 122 can be both flat and have a reduced thickness in the same area, it is not required that the flat area and the area of reduced thickness are of identical shape and size. Further, where the upper portion 122 and the lower portion 124 meet, the thickness can gradually transition from the thickness of the upper portion 122 to the thickness of the lower portion 124, or the thickness can abruptly change at the point where the upper portion 122 and the lower portion 124 meet.

Figure 7:
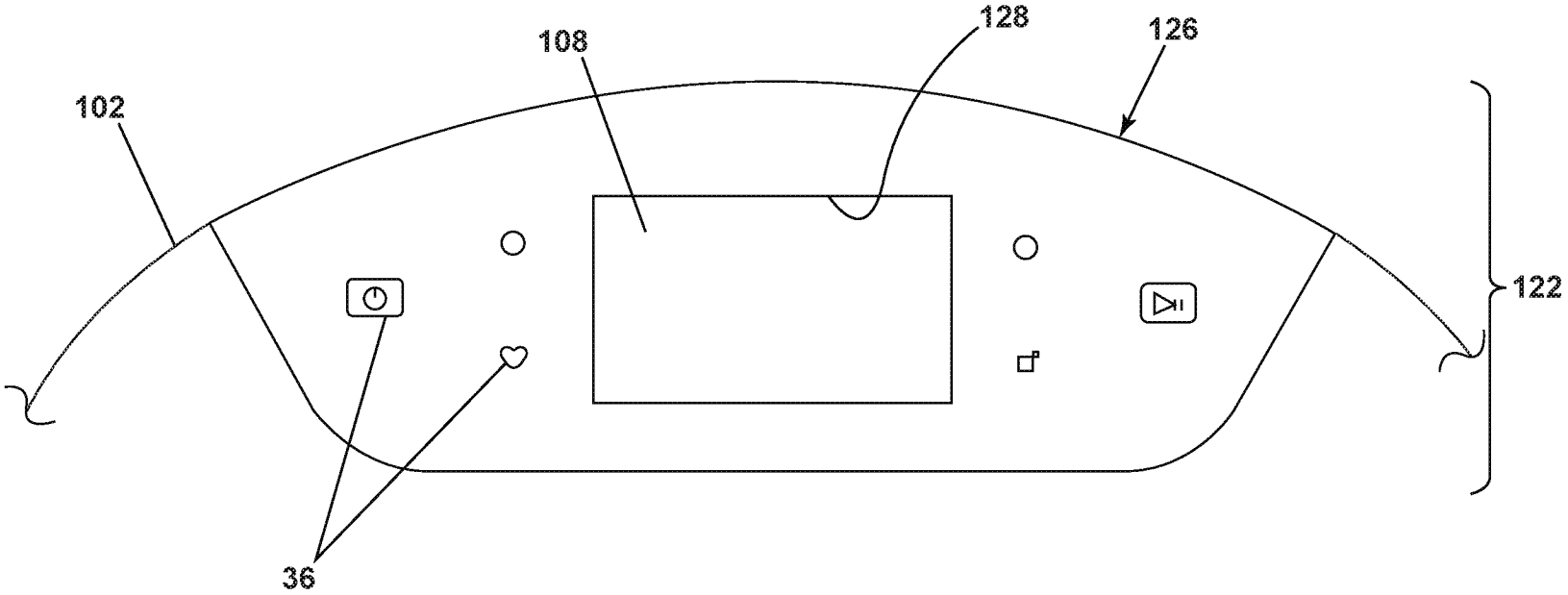
FIG. 7 illustrates a front view of a portion of the door cover of FIG. 5 according to an embodiment of the present disclosure.

FIG. 7 illustrates a front view of a visual appearance of a portion of the door cover 102. A masked portion 126 can be included to provide an opaque area of the door cover 102 to hide the components of the user interface 30, such as the at least one circuit board 112 or other electrical components. The masked portion 126 includes a mask opening 128 that corresponds to the touch film 108, the display module 34, and the display opening 116 of the intermediate door 104, such that the masked portion 126 does not impede the viewability of the display module 34. In an exemplary embodiment, the masked portion 126 is a heat transfer foil decoration applied to the rear surface 118 of the door cover 102. The at least one circuit board 112 and corresponding adhesive layer 110 can be applied to the rear surface 118 of the door cover 102, even where the masked portion 126 is already present. It will be understood that any other suitable type of masking decoration can be applied other than the use of a heat transfer foil, non-limiting examples of which include hot stamping, ink, in-mold decoration, or in-mold labelling.

The presence of the user interface 30 and associated electronics, such as the at least one circuit board 112 and the display module 34 within the door assembly 100 requires structures within the door assembly 100 to protect the user interface 30 from liquid and to divert any liquid that may enter the door assembly 100 away from the user interface 30. Referring back to FIG. 4, a groove 120 can be seen in the front surface of the intermediate door 104. The groove 120 extends circumferentially about the touch film 108, display module 34, and the at least one circuit board 112. The groove 120 is positioned such that it can accommodate a gasket 134 within the groove 120. The gasket 134 can be seen in the cross-sectional view of FIG. 6. The gasket 134 serves to ensure that any liquid and dust or debris within the door assembly 100, particularly between the intermediate door 104 and the door cover 102, is diverted away from the electronics of the user interface 30. While the gasket 134 and the groove 120 are shown as encircling the user interface 30 entirely, it will be understood that both the groove 120 and the gasket 134 can also extend only around an upper portion of the user interface 30, or in any other portion different than what is shown.

Figure 8:
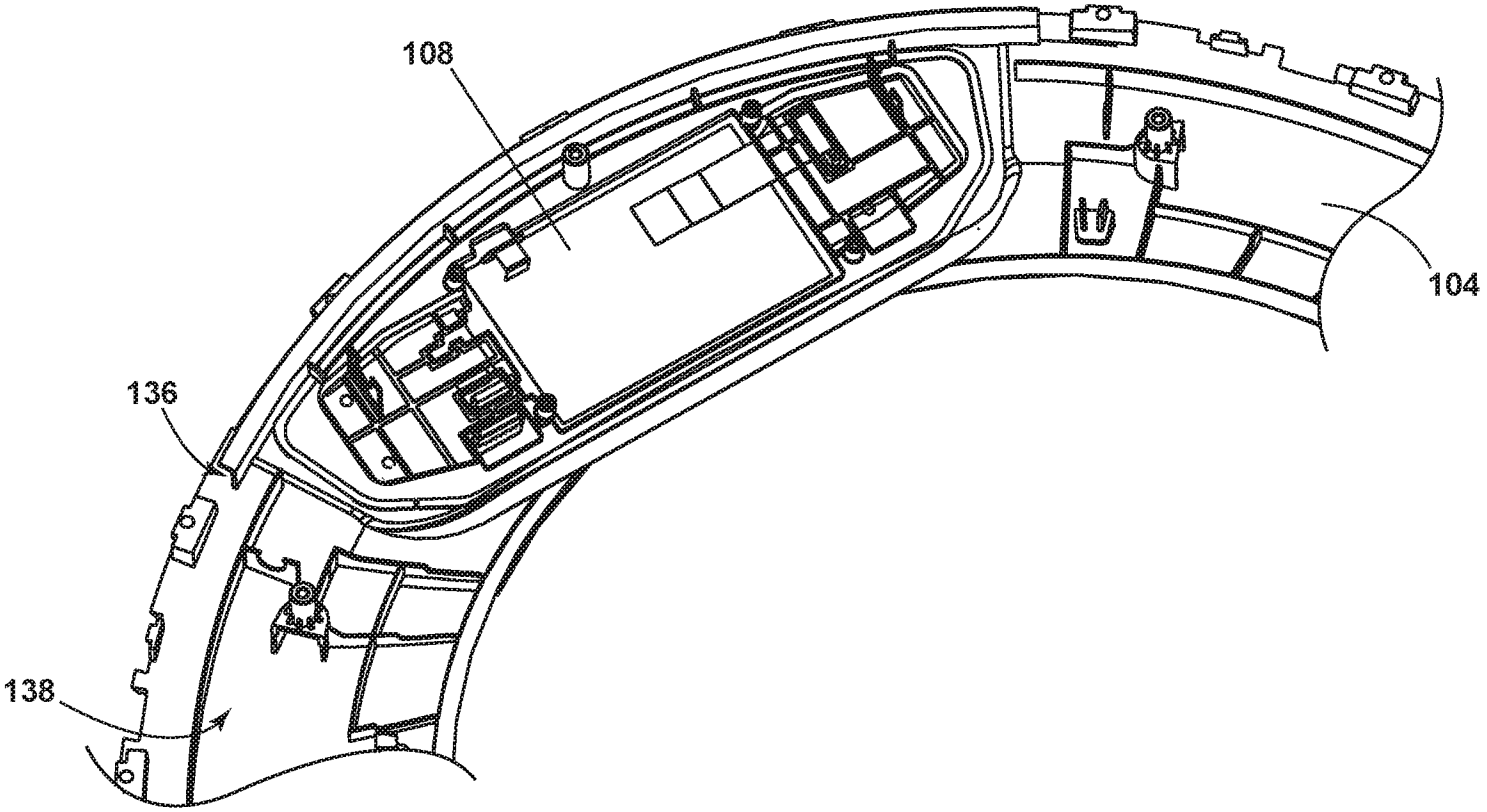
FIG. 8 illustrates an enlarged rear perspective view of an upper portion of the outer door assembly of FIG. 3 according to the present disclosure.

FIG. 8 illustrates an enlarged rear perspective view of an upper portion of the outer door assembly 140, including an additional liquid diverting structure that is present on a rear surface 138 of the intermediate door 104. A water channel 136 (also visible in cross-section in FIG. 6) extends rearwardly from the rear surface 138 of the intermediate door 104. The water channel 136 is positioned above the display opening 116 of the intermediate door 104. In an exemplary embodiment, the water channel 136 extends to a width that is at least the width of the display module 34 and the at least one circuit board 112, though it will be understood that the water channel 136 can be any suitable width such that any liquid that may be present within the door assembly 100, particularly between the intermediate door 104 and a rear door 130, is deflected away from the electronics of the user interface 30.

Figure 9:
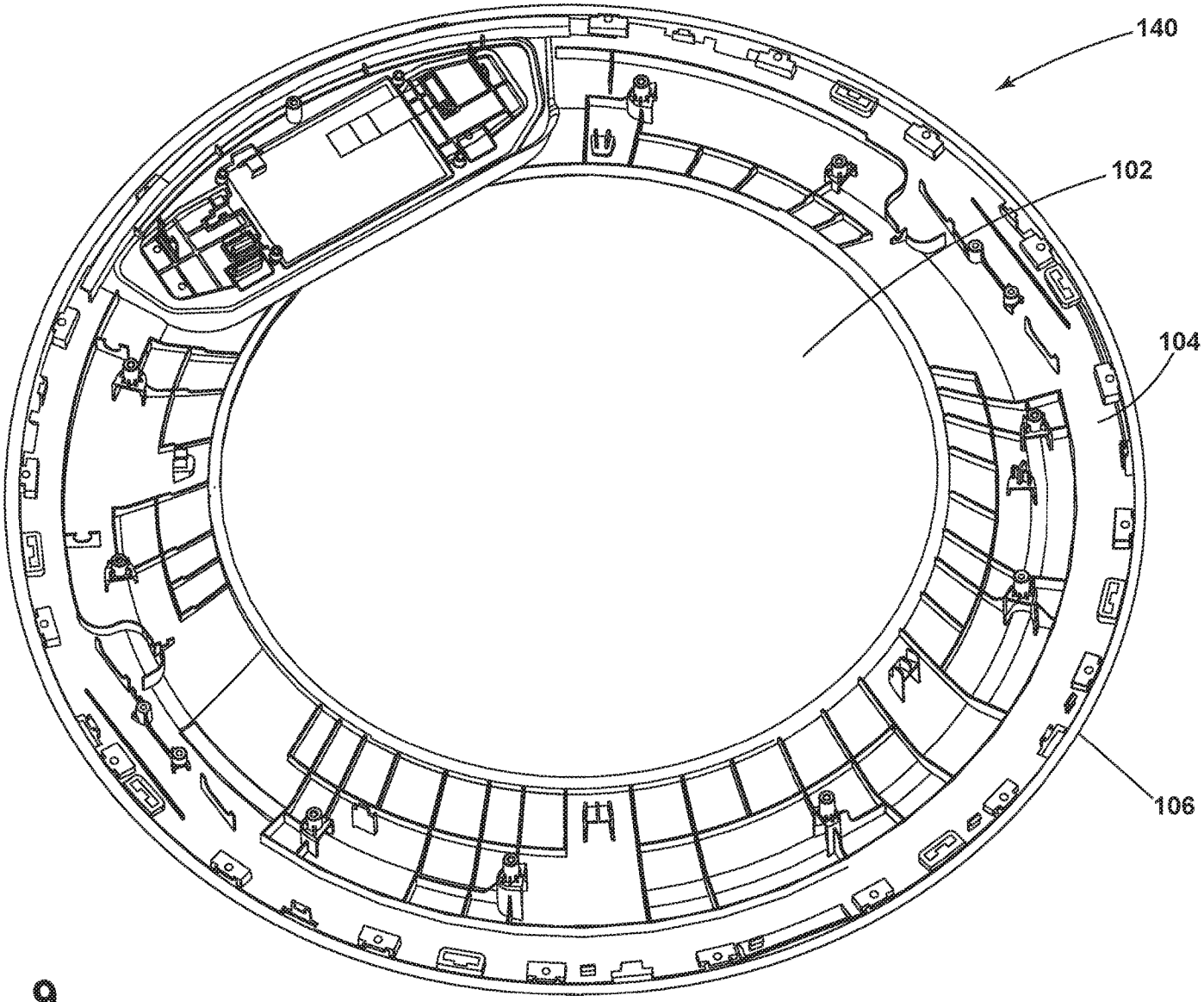
FIG. 9 illustrates a rear perspective view of the outer door assembly of FIG. 3 according to the present disclosure.
Figure 10:
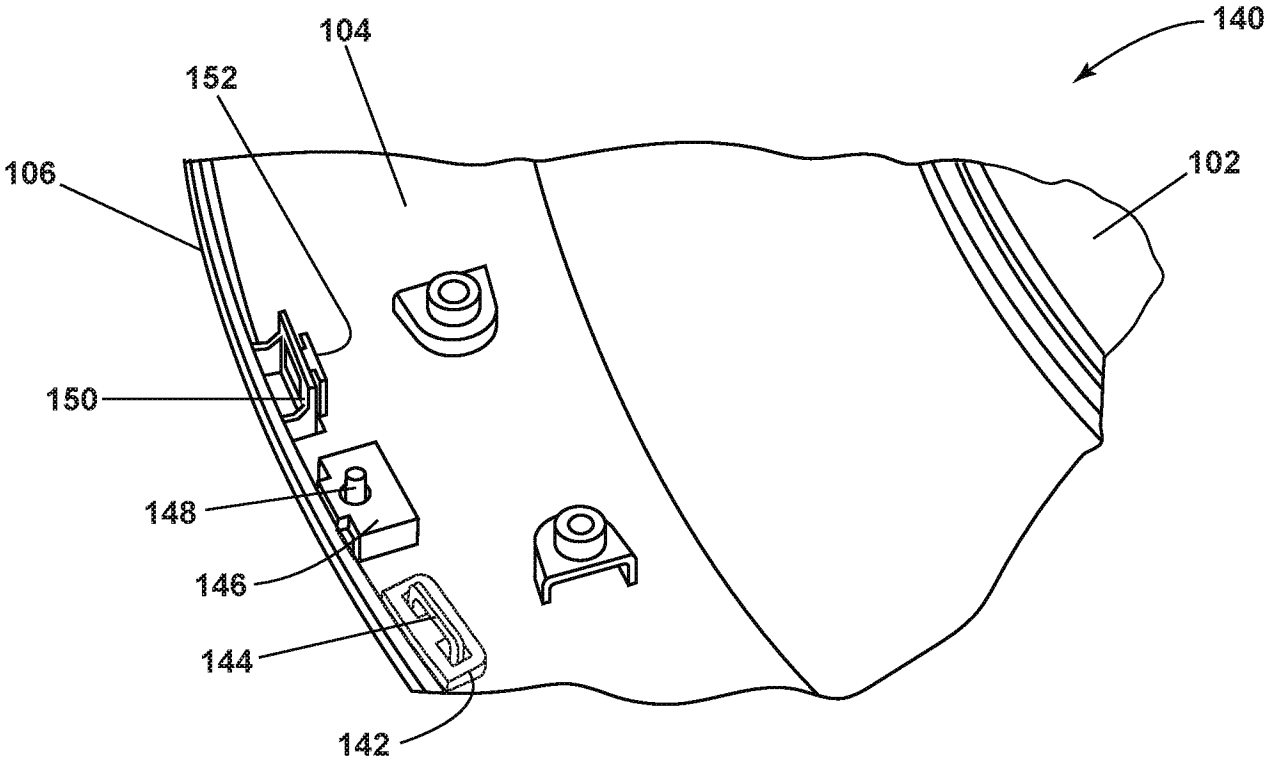
FIG. 10 illustrates an enlarged perspective view of the outer door assembly of FIG. 9 according to the present disclosure.

The outer door assembly 140 comprises a plurality of fasteners that are used in the assembling of the outer door assembly 140, as illustrated in FIGS. 9 and 10, which illustrate rear perspective views of the outer door assembly 140, including the door cover 102, the intermediate door 104, and the peripheral trim ring 106. The door cover 102 is coupled to the intermediate door 104 by a plurality of door cover hooks 144 that are received by door cover hook openings 142 provided within the intermediate door 104. In an exemplary embodiment as illustrated, there are provided eight sets of couplings of the door cover hooks 144 with the door cover hook openings 142, the eight sets being arranged along the periphery of the outer door assembly 140, and only along a lower portion of the periphery of the outer door assembly 140. However, it will be understood that any suitable number of sets of door cover hooks 144 and door cover hook openings 142 can be provided, and that they can be provided at any suitable point along the periphery of the outer door assembly 140.

Figure 11A:
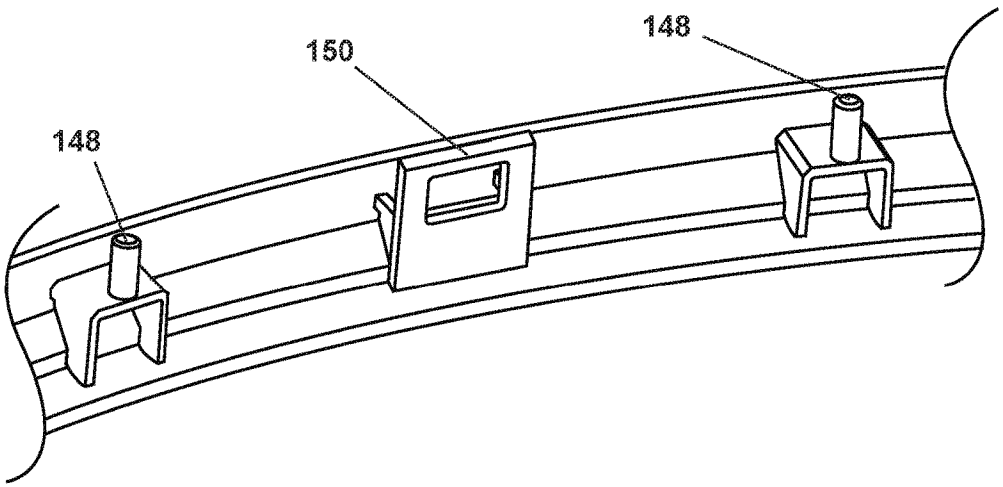
FIG. 11A illustrates an enlarged perspective view of a portion of a peripheral trim ring for use with the outer door assembly of FIG. 3 according to an embodiment of the present disclosure.
Figure 11B:
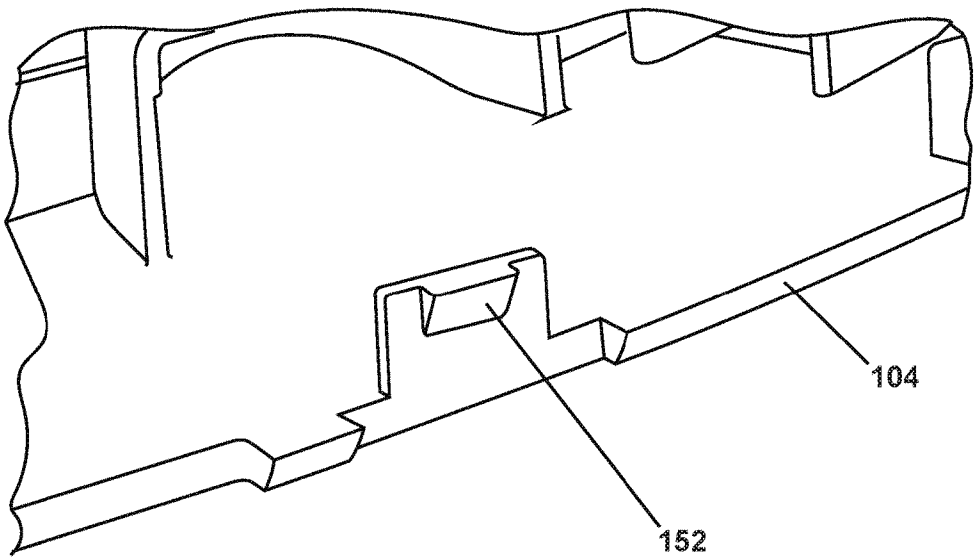
FIG. 11B illustrates an enlarged perspective view of a portion of the intermediate door for use with the outer door assembly of FIG. 3 according to an embodiment of the present disclosure.

The peripheral trim ring 106 is coupled to the intermediate door 104 by a plurality of intermediate door hooks 152 that are received within receiving windows 150 provided on the peripheral trim ring 106, which can be seen in enlarged detail in FIGS. 11A and 11B. The receiving windows 150 on the peripheral trim ring 106 are shaped to receive the intermediate door hooks 152 such that rotation of the peripheral trim ring 106 about the peripheral edge of the intermediate door 104 is prevented when the peripheral trim ring 106 is coupled to the intermediate door 104.

Referring back to FIG. 10, a third attachment feature of the outer door assembly 140 involves the coupling of the door cover 102, the intermediate door 104, and the peripheral trim ring 106 by the use of heat staking. A plurality of heat stake posts 148 are provided on the peripheral trim ring 106, projecting rearwardly from the peripheral trim ring 106 towards the treating chamber 18. The heat stake posts 148 are received by a corresponding number of heat stake towers 146 formed in the intermediate door 104 and defining receiving openings for the heat stake posts 148. A plurality of sets of the heat stake posts 148 and the heat stake towers 146 can be distributed about the periphery of the outer door assembly 140, such that the heat stake posts 148 are arranged about a perimeter of the intermediate door 104 and the heat stake towers 146 are arranged about a perimeter of the peripheral trim ring 106. The heat stake posts 148 can be received within the heat stake towers 146 of the intermediate door 104 when the door cover 102 and the intermediate door 104 have been coupled together via the door cover hooks 144 and the door cover hook openings 142, such that the peripheral trim ring 106 sandwiches the door cover 102 between the peripheral trim ring 106 and the intermediate door 104. Alignment locators (not shown) can be provided to ensure that the door cover 102, the intermediate door 104, and the peripheral trim ring 106 are aligned properly. Non-limiting examples of such an alignment locator can include notches, protrusions, or indentations that are complementary to one another between the door cover 102, the intermediate door 104, and the peripheral trim ring 106. Any suitable number of such alignment locators can be provided, including a plurality of alignment locators or only a single alignment locator.

While the heat stake posts 148 are illustrated herein as being provided on the peripheral trim ring 106 and the heat stake towers 146 defining the receiving openings are illustrated herein as being provided on the intermediate door 104, it will be understood that the heat stake posts 148 can be provided on either the peripheral trim ring 106 or the intermediate door 104, with the heat stake towers 146 defining the receiving openings can be provided on the other of the peripheral trim ring 106 or the intermediate door 104, such that the heat stake posts 148 and the heat stake towers 146 defining the receiving openings collectively form first and second parts of a heat stake connection.

Figure 12B:
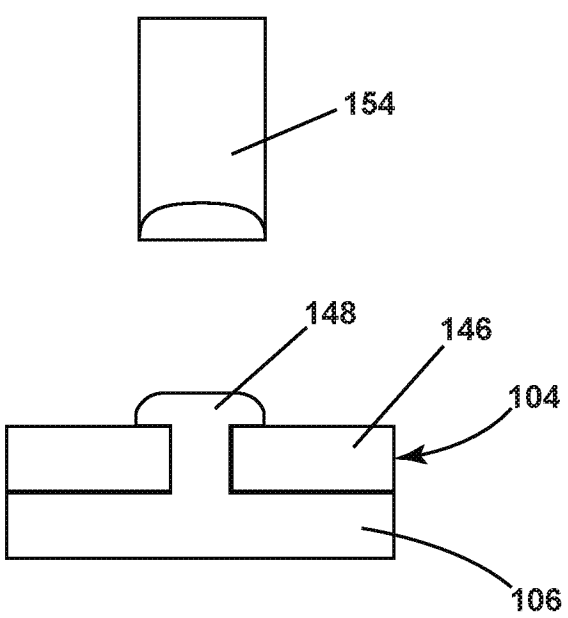
FIG. 12B illustrates a schematic view of a heated heat stake post for use with the outer door assembly of FIG. 3 according to the present disclosure.
Figure 12A:
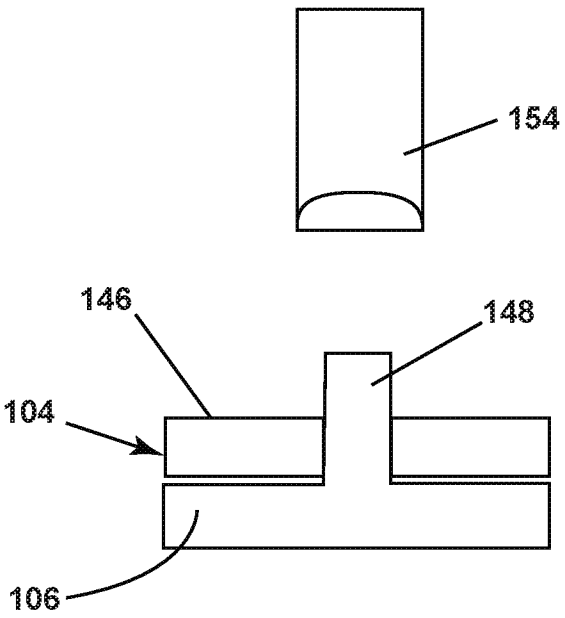
FIG. 12A illustrates a schematic view of a heat stake post for use with the outer door assembly of FIG. 3 according to the present disclosure.

Referring now to FIG. 12A, a schematic cross-sectional view of the heat stake post 148 and heat stake tower 146 are shown. When the door cover 102, the intermediate door 104, and the peripheral trim ring 106 have been aligned and the heat stake posts 148 are received within the heat stake towers 146, heat can be applied by a heating apparatus 154 in order to melt the top of the heat stake posts 148 while applying downward pressure to create a cap, illustrated herein as a mushroom-shaped top, on the heat stake posts 148 and couple the peripheral trim ring 106 to the intermediate door 104, as shown in FIG. 12B. While the cap is illustrated herein as a mushroom-shaped or flattened top, it will be understood that the cap can have any suitable shape. In an exemplary embodiment, the heating apparatus 154 can be a heating machine, a non-limiting example of which includes an ultrasonic heating machine, though it will be understood that any suitable heating device can be used. The melting of the heat stake towers 146 creates a robust coupling between the peripheral trim ring 106 and the intermediate door 104, such that there is no looseness between the two parts to create squeaking or rattling during the operation of the laundry treating appliance 10.

Figure 13:
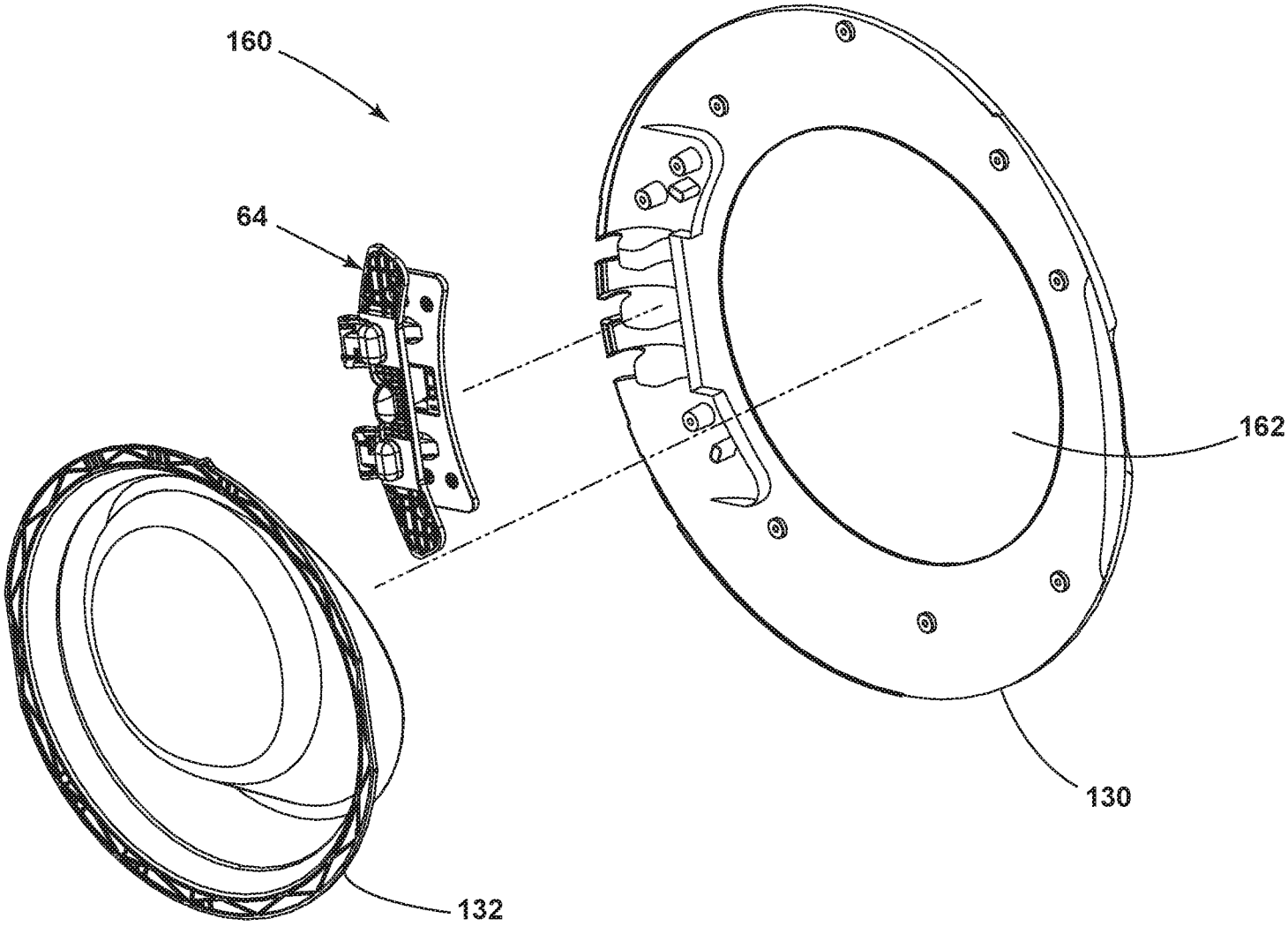
FIG. 13 illustrates an exploded view of the inner door assembly of FIG. 3 according to an embodiment of the present disclosure.

FIG. 13 illustrates an exploded view of an exemplary embodiment of the inner door assembly 160 that can be used in the door assembly 100. In the exemplary embodiment, the inner door assembly 160 can be used to form the door assembly 100 for a laundry washing appliance, though it will be understood that the inner door assembly 160 can also be used in any other type of laundry treating appliance 10. The inner door assembly 160 comprises the rear door 130, the hinge assembly 64, and a door inner window 132. In an exemplary embodiment, the door inner window 132 can have the shape of a bowl, although it will be understood that any suitable shape can be used, including a flat window, or a concave or convex window that is not shaped like a bowl. The rear door 130 includes a door inner window opening 162 that is designed to receive the door inner window 132. When the door inner window 132 is received within the door inner window opening 162 of the rear door 130, and the inner door assembly 160 is coupled to the outer door assembly 140 to form the door assembly 100, the door inner window 132 is aligned with the central opening 114 of the intermediate door 104 to allow a user to view the treating chamber 18 when the door assembly 100 is in the closed condition. In an exemplary embodiment, both the rear door 130 and the door inner window 132 can be formed of plastic, although it will be understood that the rear door 130 can also be formed from metal, composite, or other suitable material, while the door inner window 132 can also be formed of glass.

Figure 14:
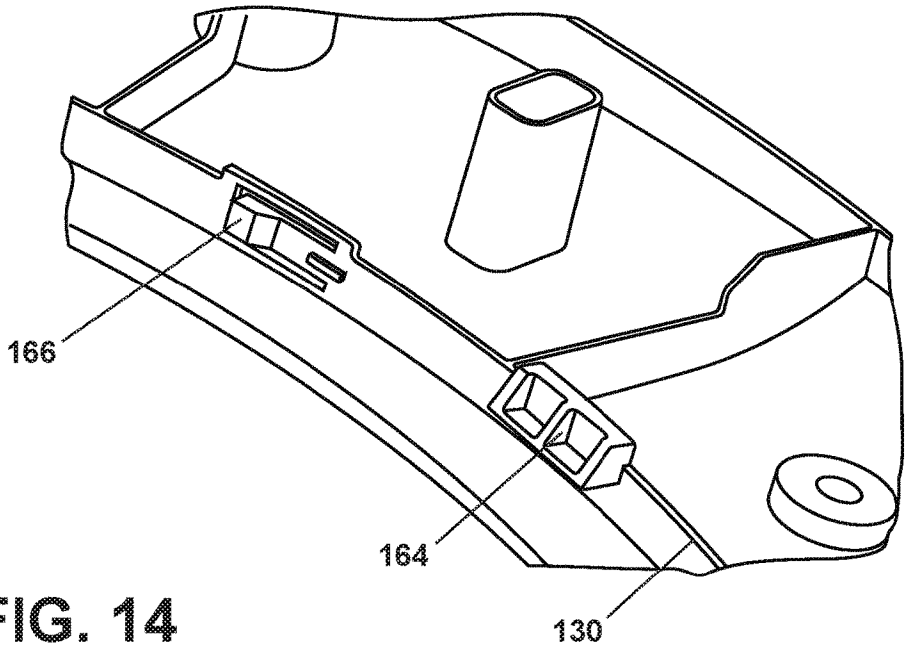
FIG. 14 illustrates an enlarged perspective view of a rear door for use with the inner door assembly of FIG. 13 according to the present disclosure.
Figure 15:
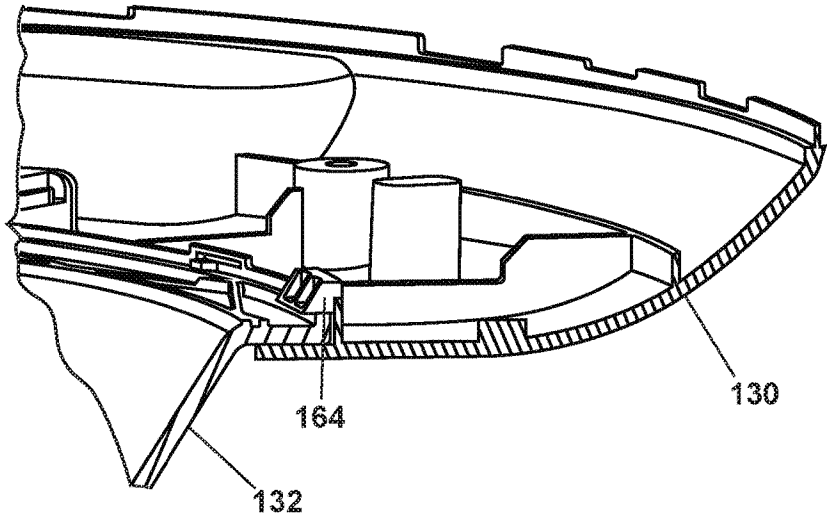
FIG. 15 illustrates an enlarged cross-sectional view of the inner door assembly of FIG. 13 according to the present disclosure.

The inner door assembly 160 includes fastening elements for coupling the door inner window 132 to the rear door 130, which are illustrated in FIG. 14 in the form of a plurality of holding snaps 164 and a plurality of centering snaps 166 provided along the periphery of the door inner window opening 162 of the rear door 130. As shown in an enlarged cross-sectional view in FIG. 15, the holding snaps 164 sandwich the door inner window 132 against the rear door 130 securely such that the door inner window 132 is tightly held and does not allow for gaps between the door inner window 132 and the rear door 130.

Figure 16:
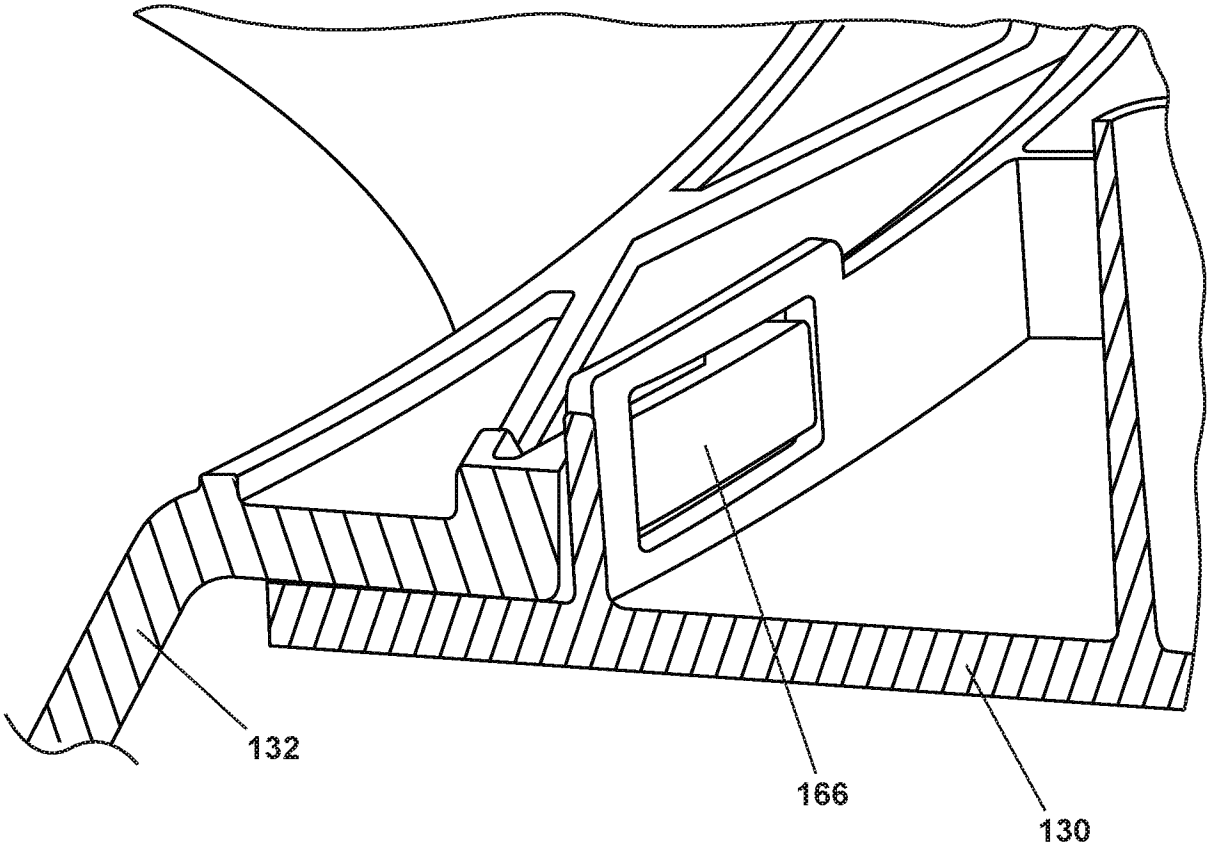
FIG. 16 illustrates an enlarged cross-sectional view of the inner door assembly of FIG. 13 according to the present disclosure.

The centering snaps 166 are shown in enlarged cross-sectional view in FIG. 16. The centering snaps 166 are resiliently biased against the door inner window 132. In an exemplary embodiment, the centering snaps 166 are distributed evenly about the periphery of the door inner window opening 162 of the rear door 130 such that an even and balanced amount of pressure is applied to the door inner window 132 by the centering snaps 166 from any given direction. In this way, the biasing of the centering snaps 166 against the door inner window 132 serves to center the door inner window 132 within the door inner window opening 162.

Figure 17:
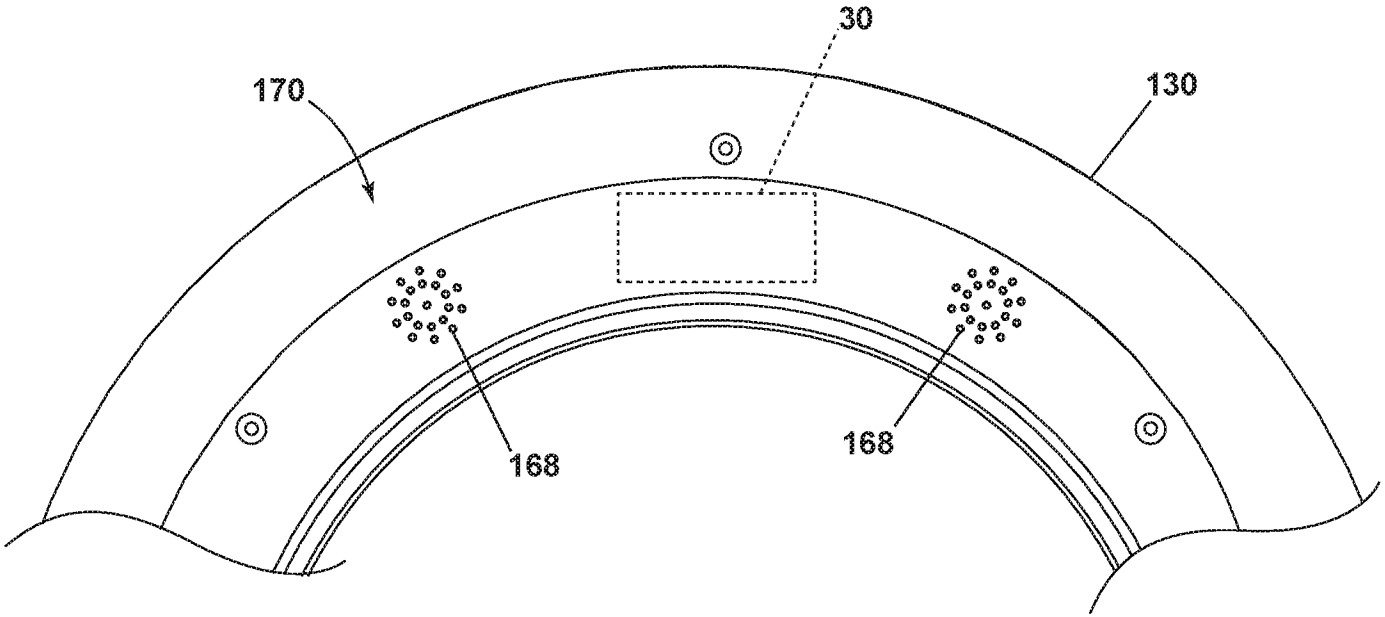
FIG. 17 illustrates a rear perspective view of a portion of the rear door for use with the inner door assembly of FIG. 13 according to the present disclosure.

FIG. 17 illustrates a rear perspective view of an upper portion of the rear door 130. A rear surface 170 of the rear door 130 contains at least one set of speaker openings 168 that pass through the rear surface 170 of the rear door 130. In an exemplary embodiment, two sets of speaker openings 168 are provided, one set on either side of the position of the user interface 30 and the display module 34. The speaker openings 168 allow sound from the user interface 30 to exit the door assembly 100 and be projected such that a user can hear the audible sounds from the user interface 30. It will be understood that any suitable number of speaker openings 168 or sets of speaker openings 168 can be provided, including a single set of speaker openings 168, and that they can be provided at any suitable location on the rear door 130.

Figure 18:
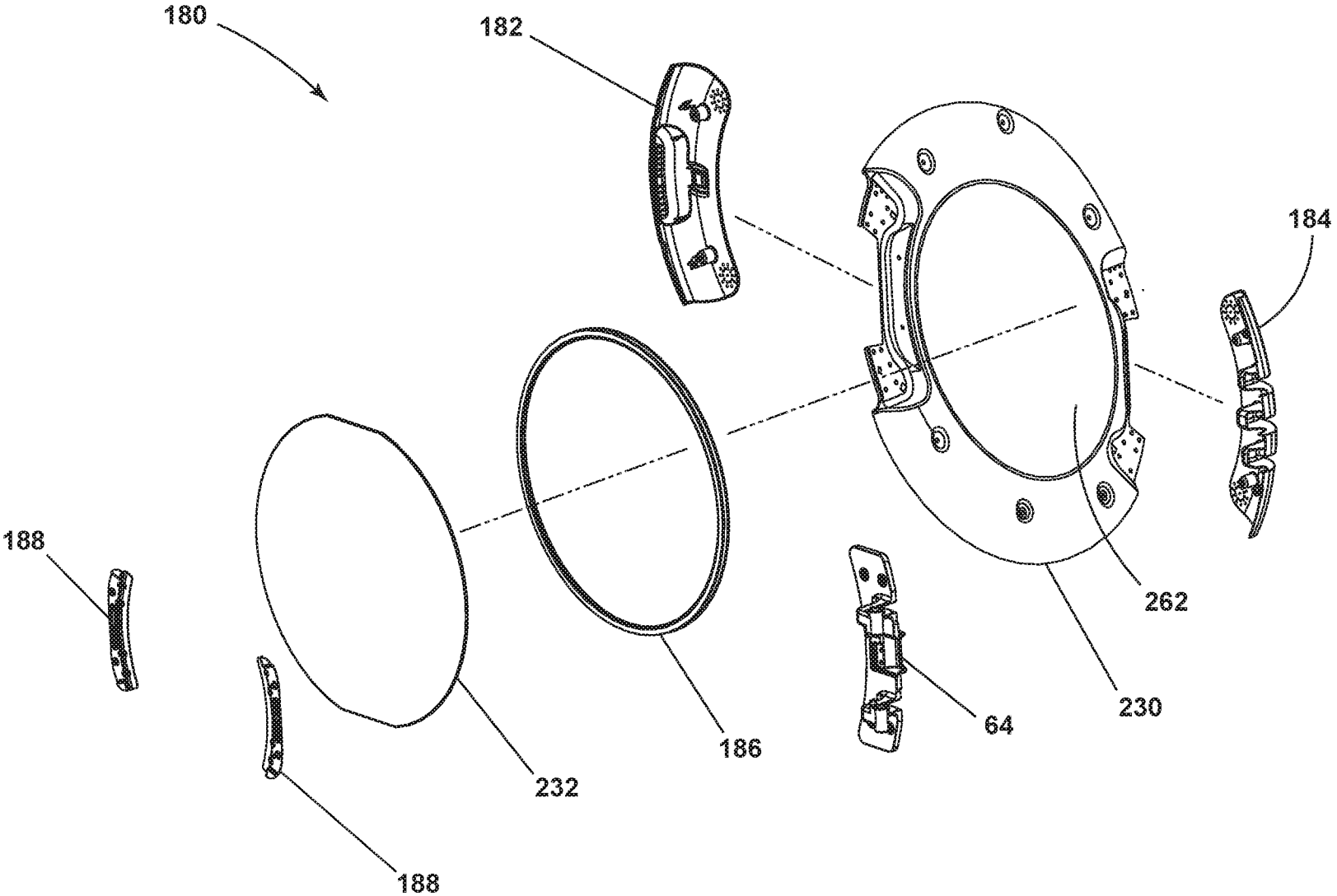
FIG. 18 illustrates an exploded view of an inner door assembly for use with the door assembly of FIG. 2 according to an embodiment of the present disclosure.

FIG. 18 illustrates an exploded view of another exemplary embodiment of the inner door assembly 180 that can be used in the door assembly 100. In the exemplary embodiment, the inner door assembly 180 can be used to form the door assembly 100 for a laundry drying appliance, though it will be understood that the inner door assembly 180 can also be used in any other type of laundry treating appliance 10. The inner door assembly 180 comprises a rear door 230, the hinge assembly 64, and a door window 232. The rear door 230 includes a door window opening 262 that is designed to receive the door window 232. When the door window 232 is received within the door window opening 262 of the rear door 230, and the inner door assembly 180 is coupled to the outer door assembly 140 to form the door assembly 100, the door window 232 is aligned with the central opening 114 of the intermediate door 104 to allow a user to view the treating chamber 18 when the door assembly 100 is in the closed condition. A seal 186 can be provided where the door window 232 is received within the door window opening 262. In an exemplary embodiment, the rear door 230 is formed of metal, while the door window 232 is formed of glass, although it will be understood that the rear door 230 can also be formed from plastic or other suitable material, while the door window 232 can also be formed of plastic.

The inner door assembly 180 includes fastening elements for coupling the door window 232 to the rear door 230, which can be in the form of holding snaps 164 and centering snaps 166 as described previously within the inner door assembly 160, or the fastening elements can be provided in the form of clamps 188 as shown in FIG. 18. The clamps can be fastened to the rear door 230 in order to hold the door window 232 in place within the door window opening 262. In an exemplary embodiment, both the clamps 188 and the rear door 230 are formed of steel.

The inner door assembly 180 further includes a handle cover 182 and a hinge cover 184 that are coupled to the rear door 230. The hinge assembly 64 can be attached to either side of the rear door 230, depending on the preference of the user. Whichever side the user chooses of the rear door 230 to attach the hinge assembly 64 to, the hinge cover 184 can be coupled to the rear door 230 on the side corresponding to the position of the hinge assembly 64, with the handle cover 182 being coupled to the rear door 230 on the side opposite the position of the hinge assembly 64. In an exemplary embodiment, both the handle cover 182 and the hinge cover 184 are formed of plastic, though it will be understood that any suitable material, including metal, can be used.

Figure 19:
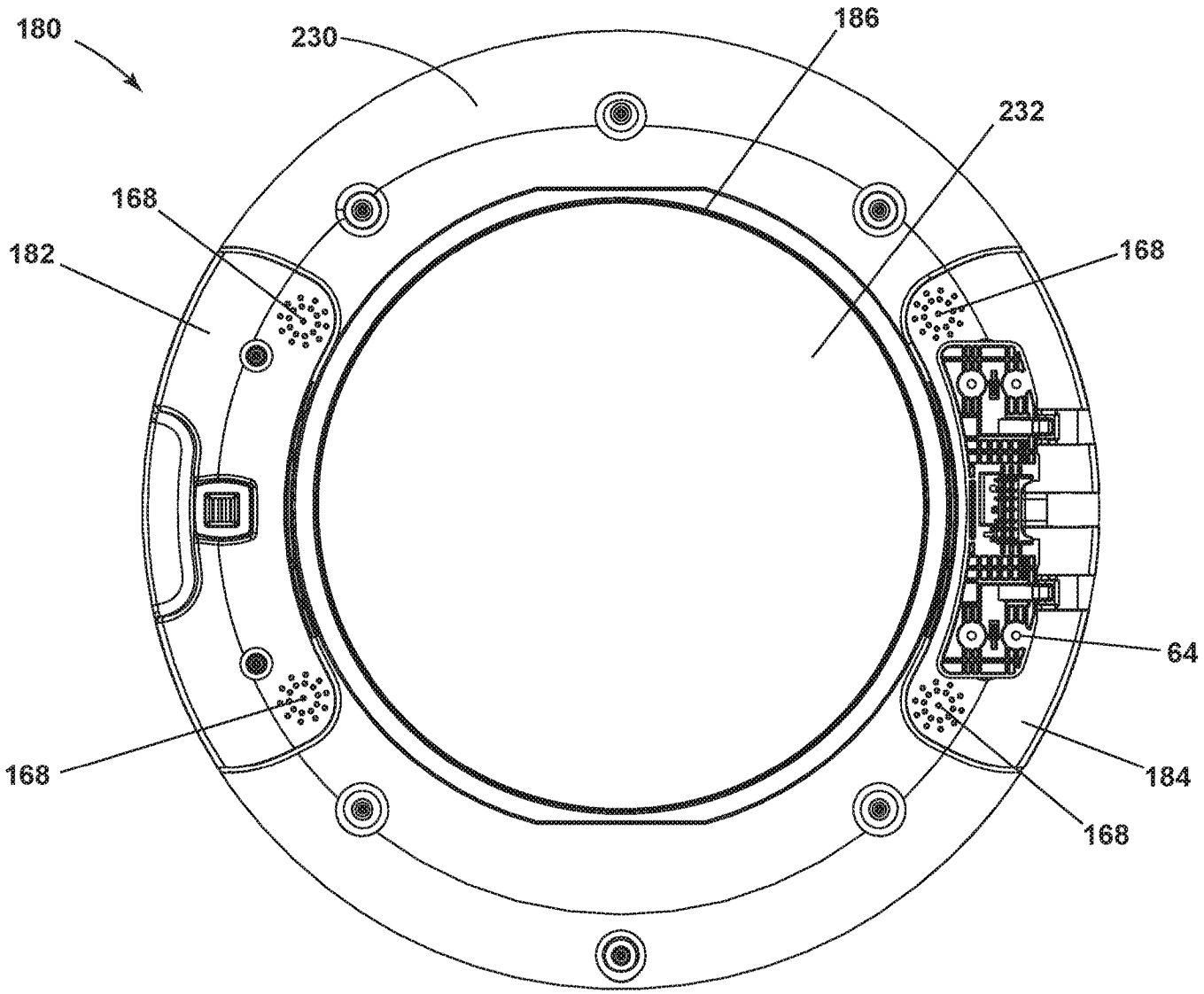
FIG. 19 illustrates a rear view of the inner door assembly of FIG. 18 according to the present disclosure.

FIG. 19 illustrates a rear view of the inner door assembly 180 with the hinge assembly 64, the hinge cover 184, and the handle cover 182 in position and coupled to the rear door 230. Both the handle cover 182 and the hinge cover 184 have a set of speaker openings 168 at both an upper portion and a lower portion, such that even if the handle cover 182 and the hinge cover 184 were switched to opposite sides of the rear door 230, along with the hinge assembly 64, the user is assured that a set of speaker openings 168 will still be in place for optimal sound transmission.

Figure 20:
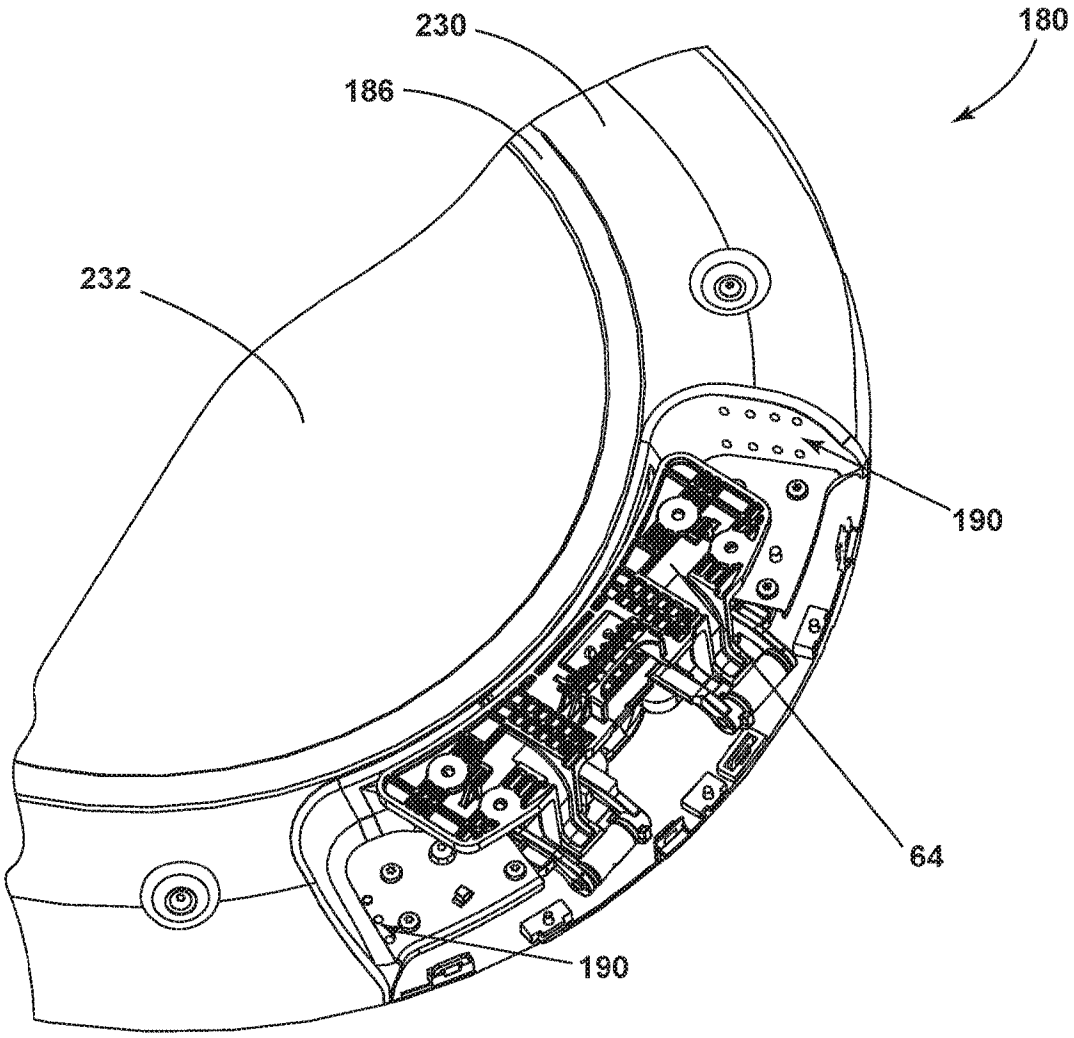
FIG. 20 illustrates a rear perspective view of a portion of the inner door assembly of FIG. 18 according to the present disclosure.

FIG. 20 illustrates a rear perspective view of the rear door 230, including a hole pattern 190 that can be provided in the rear door 230. The hole pattern 190 allows for sound to exit the rear door 230 from the user interface 30, such that the sound can most effectively reach the speaker openings 168 of the handle cover 182 or the hinge cover 184 in order to be transmitted to the user from the door assembly 100. The hole pattern 190 is illustrated herein as being provided either on a horizontal or vertical surface of the rear door 230. It will be understood that such arrangements of the hole pattern 190 can be provided either on their own or together and either above or below the hinge assembly 64. By way of non-limiting example, the portion of the rear door 230 either above or below the hinge assembly 64 can be provided with a hole pattern 190 on a horizontal surface of the rear door 230, on a vertical surface of the rear door 230, or both the horizontal and the vertical surfaces of the rear door 230. The portions of the rear door 230 above and below the hinge assembly 64 can be provided with identical hole patterns 190, or the hole pattern 190 can differ above and below the hinge assembly 64.

Turning now to the assembling of the door assembly 100, the door cover 102, intermediate door 104, and peripheral trim ring 106 are coupled to one another to form the outer door assembly 140 using the various fasteners as described previously with respect to FIG. 10. Once the outer door assembly 140, including the touch film 108, the at least one circuit board 112, and the adhesive layer 110, has been completed, the display module 34 can then be fastened to the intermediate door 104. The display module 34 can be fastened to the intermediate door 104 using any suitable fastener, non-limiting examples of which include screws, bolts, snaps, or clamps. The display module 34 is fastened to the intermediate door 104 such that the display module 34 is aligned with the display opening 116 of the intermediate door 104, and therefore also aligned with the touch film 108 and the flat upper portion 122 of the door cover 102. Then, depending on the type of laundry treating appliance the door assembly 100 is needed for, as well as the desired features of the door assembly 100, either of the inner door assemblies 160, 180 can be attached to the outer door assembly 140 by means of suitable fasteners, non-limiting examples of which include screws, bolts, snaps, or clamps. The hinge assembly 64, which is attached as a part of the inner door assembly 160, 180, can then be attached to the cabinet 12 by means of suitable fasteners, non-limiting examples of which include screws, bolts, snaps, or clamps.

The embodiments described herein set forth a door assembly for a laundry treating appliance that allows for a user interface to be used that is appealing and ergonomically satisfying for a user, as well as setting forth a variety of features for ensuring the stability of the door assembly, for protecting the user interface and associated electronics from liquid, for improving the usability of the touch interface and improving sound transmission to a user, and for providing flexibility for the type of laundry treating appliance that the door assembly can be used with, even allowing a user to select which way they would like the door to open in certain embodiments.

To the extent not already described, the different features and structures of the various embodiments can be used in combination with each other as desired, or can be used separately. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention. Hence, specific dimensions and other physical characteristics relating to the embodiments disclosed herein are not to be considered as limiting, unless expressly stated otherwise.

What is claimed is:

1. A laundry treating appliance comprising:

a cabinet defining an interior;

a drum located within the interior and defining a treating chamber; and a door assembly coupled to the cabinet to selectively open and close the treating chamber and at least partially defining the treating chamber when the door assembly is in a closed condition, the door assembly comprising:

an intermediate door having front and rear surfaces, defining an opening, and having a plurality of receiving openings, a plurality of cover hook openings and a plurality of intermediate door hooks;

a user interface mounted to the intermediate door;

a door cover adjacent the front surface of the intermediate door and overlying the user interface and comprising a plurality of door cover hooks engaging the plurality of cover hook openings for coupling the door cover to the intermediate door;

a rear door adjacent the rear surface of the intermediate door;

a door window mounted to the rear door and overlying the opening; and a trim element provided about at least a periphery of the intermediate door and having a plurality of receiving windows and a plurality of posts, the posts are received within the receiving openings, wherein the posts are melted creating a plurality of caps that secure the trim element to the intermediate door and wherein the plurality of receiving windows are shaped to receive the intermediate door hooks to prevent rotation of the trim element relative to the intermediate door.

2. The laundry treating appliance of claim 1, wherein the plurality of receiving openings are arranged about a perimeter of the intermediate door.

3. The laundry treating appliance of claim 2, wherein the plurality of posts are arranged about a perimeter of the trim element.

4. The laundry treating appliance of claim 1, wherein the trim element surrounds at least the periphery of the intermediate door.

5. The laundry treating appliance of claim 1, wherein the number of receiving openings corresponds to the number of posts.

6. The laundry treating appliance of claim 1, wherein the trim element is provided about at least the periphery of the intermediate door and a periphery of the door cover.

7. The laundry treating appliance of claim 6, wherein the trim element sandwiches the door cover between the trim element and the intermediate door.

8. The laundry treating appliance of claim 1, wherein the melting is done by ultrasonic heating of the posts.

9. The laundry treating appliance of claim 1, wherein the posts project from a rear surface of the trim element.

10. The laundry treating appliance of claim 9, wherein the posts project toward the treating chamber.

11. The laundry treating appliance of claim 1, wherein the door cover is coupled to the intermediate door prior to the trim element being coupled to the intermediate door.

12. The laundry treating appliance of claim 1, wherein the plurality of cover hook openings are arranged about a perimeter of the intermediate door.

13. The laundry treating appliance of claim 12, wherein the plurality of intermediate door hooks are arranged about a perimeter of the intermediate door.

14. The laundry treating appliance of claim 1, wherein the plurality of door cover hooks are arranged about a perimeter of the door cover.

15. The laundry treating appliance of claim 14, wherein the number of door cover hooks corresponds to the number of cover hook openings.

16. The laundry treating appliance of claim 1, wherein the plurality of receiving windows is arranged about a perimeter of the trim element.

17. The laundry treating appliance of claim 16, wherein the number of receiving windows corresponds to the number of intermediate door hooks.

18. The laundry treating appliance of claim 1, wherein each of the plurality of intermediate door hooks projects into each of the plurality of receiving windows.

* * * * *